US005375799A

United States Patent [19]

Rhodes

[11] Patent Number: 5,375,799

[45] Date of Patent: Dec. 27, 1994

[54] COLLECTION BAG HANGER WITH RAIL WIDTH-ADJUSTABLE HOOK ARMS

[75] Inventor: David D. Rhodes, Cary, Ill.

[73] Assignee: Hollister Incorporated, Libertyville, Ill.

[21] Appl. No.: 951,222

[22] Filed: Sep. 25, 1992

[51] Int. Cl.[5] ..... B65B 67/12

[52] U.S. Cl. ..... 248/95; 128/DIG. 24; 248/215; 604/322

[58] Field of Search ..... 248/214, 215, 328, 95; 604/322, 317; 128/DIG. 24

[56] References Cited

U.S. PATENT DOCUMENTS

| | | | |
|---|---|---|---|
| 837,642 | 12/1906 | Powell | 248/215 X |
| 1,552,196 | 9/1925 | Bastis | 248/214 X |
| 2,992,854 | 7/1961 | Berlin | 248/215 X |
| 3,088,126 | 7/1963 | Klingler . | |
| 3,090,968 | 5/1963 | Buono . | |
| 3,220,434 | 11/1965 | Garth . | |
| 3,237,624 | 3/1966 | Jinkens | 128/DIG. 24 X |
| 3,345,023 | 10/1967 | Scott et al. . | |
| 3,354,738 | 10/1970 | Huck . | |
| 3,529,598 | 9/1970 | Waldman . | |
| 3,534,738 | 10/1970 | Huck | 128/DIG. 24 X |
| 3,537,109 | 11/1970 | Spurrier et al. . | |
| 3,596,859 | 8/1971 | MacDonald | 248/214 |
| 3,765,632 | 10/1973 | Riggs | 248/215 X |
| 4,019,707 | 4/1977 | Quinn et al. . | |
| 4,027,842 | 6/1977 | Mittleman . | |
| 4,051,578 | 10/1977 | Manschot et al. . | |
| 4,219,177 | 8/1980 | O'Day . | |
| 4,254,771 | 3/1981 | Vidal . | |
| 4,312,352 | 1/1982 | Meisch et al. . | |
| 4,317,550 | 3/1982 | Hannah . | |
| 4,332,252 | 6/1982 | Taylor | 248/328 X |
| 4,393,880 | 7/1983 | Taylor | 604/322 X |
| 4,477,046 | 10/1984 | Repp | 248/95 |
| 4,501,584 | 2/1985 | Cianci et al. . | |
| 4,534,766 | 8/1985 | Steer et al. . | |
| 4,562,984 | 1/1986 | Sherlock et al. . | |
| 4,650,478 | 3/1987 | Dunn . | |
| 4,888,005 | 2/1989 | Dingeman et al. . | |
| 4,944,434 | 7/1990 | Hamilton | 248/214 X |
| 4,979,714 | 12/1990 | Russell et al. . | |
| 4,997,426 | 3/1991 | Dingeman et al. . | |
| 5,054,735 | 10/1991 | Bayer . | |

FOREIGN PATENT DOCUMENTS

| | | | |
|---|---|---|---|
| 804351 | 4/1951 | Germany | 248/215 |

*Primary Examiner*—J. Franklin Foss
*Attorney, Agent, or Firm*—Tilton Fallon Lungmus

[57] ABSTRACT

A collection bag hanger is disclosed for attaching fluid collection bags, such as a urinary drainage bags, to beds having bedrails of different widths. The collection bag hanger comprises a central body portion having parallel side edges, an attachment strap for releasably supporting the fluid collection bag, and a pair of opposed hook arms of generally inverted U-shaped configuration, each hook arm having a first depending leg portion hingedly connected to one of the side edges of the central body portion. A rigid strap member is provided for securing the hook arms in any of a plurality of symmetrical angular positions for receiving and securely engaging bedrails of different widths.

11 Claims, 2 Drawing Sheets

COLLECTION BAG HANGER WITH RAIL WIDTH-ADJUSTABLE HOOK ARMS

BACKGROUND AND SUMMARY

The present invention relates to liquid drainage systems, and more particularly, to a hanger for attaching fluid collection bags to bedrails of different widths.

Liquid drainage systems, and more particularly urine drainage systems, are commonly used in hospitals where it is frequently necessary to collect urine or other fluids from a patient. Such drainage systems typically employ a catheter which has a proximal end connected to the patient and a distal end communicating directly with a fluid collection bag. In use, the collection bag is supported below the patient so that urine will drain by gravity through the catheter into the collection bag for subsequent disposal.

Currently, urinary collection bags of the above type system are commonly attached to a bedrail of the patient's bed using a hanger which supports the collection bag. One such type of hanger typically has a central member for supporting the collection bag and a pair of opposed hook arms connected to the central member so that the hook arms can receive a bedrail and support the collection bag. Such hangers commonly are designed so that in use the hook arms are arranged into parallel positions and the bedrail is tightly received between the front and rear depending legs of the hook arms. The hook arms must create a relatively tight fit over the bedrails, otherwise, as the bag fills, the center of gravity will shift causing the bag and hanger to tilt and possibly fall free from the bedrail which may result in inconvenience and possible injury to a patient. For examples of such collection bag hangers which utilize opposed hook arms for attachment to a bedrail, reference may be had to U.S. Pat. Nos. 4,312,352 and 4,501,584.

A characteristic shortcoming of such a collection bag hanger is that a specific bag hanger will effectively accommodate only one size bedrail, that is, a bedrail having a width that corresponds closely to the distance between the depending legs of the hook arms. If the width of the bedrail is larger then, obviously, the hanger cannot be connected, whereas if the width of the bedrail is substantially smaller than the distance between the legs, the hanger and bag will not be restrained from tilting. Even if the hook arms of such a hanger are placed over a smaller bedrail and the arms are placed at divergent angular positions to closely accommodate the bedrail, the bag and hanger will still not be restrained from titling as the increasing weight of the bag will draw the hook arms into their parallel positions in which the hook arms no longer closely accommodate the smaller bedrail. Consequently, due to the wide variety hospital beds, companies must manufacture and hospitals must currently stock several different types and sizes of collection bag hangers to accommodate bedrails of different widths.

The present invention addresses the above problem by providing a collection bag hanger having a central body portion with attachment means for releasably supporting a fluid collection bag and a pair of hook arms which may be locked in a plurality of selected angular positions for receiving and securely engaging bedrails of different widths. Each hook arm is of generally inverted U-shaped configuration and has a first depending leg portion hingedly connected to a side edge of the central body portion, a second depending leg portion in spaced parallel relation to the first depending leg portion, and an intermediate portion extending between and connecting the first and second depending leg portions. Linking means in the form of a rigid strap member is extendable between the intermediate portions of the hook arms, and releasable locking means provided by the strap member and the intermediate portions of the hook arms are provided for locking the hook arms in any of a plurality of selected angular positions depending on the particular width of the bedrail to which the hanger is to be attached.

The locking means may comprise a locking pin provided by at least one of the hook arms and projecting upwardly from the intermediate portion thereof and a series of locking apertures along the strap member for selectively receiving the locking pin or pins. In use, the hook arms are rotated about the central body portion into selected symmetrical angular portions corresponding to the width of the bedrail such that the hook arms snugly receive the bedrail. The strap member is then affixed to lock the hook arms in their symmetrical angular positions of adjustment in which they securely engage the bedrail.

Among the advantages of the present invention is the fact that the bag hanger can be molded in one piece with the central body portion, the attachment means for releasably supporting the fluid collection bag, the pair of hook arms, the strap member and the locking means all extending generally in the same plane, thereby facilitating manufacture, packaging, storage and use. Since one size is adjustable to fit rails of any of a number of widths, the hanger of this invention negates the need for hospitals to stock (or companies to manufacture) a variety of collection bag hangers to accommodate bedrails of different widths.

Other features, advantages, and objects of the invention will become apparent in the specification and drawings.

DRAWINGS

DETAILED DESCRIPTION OF PREFERRED EMBODIMENT

Figure 1:
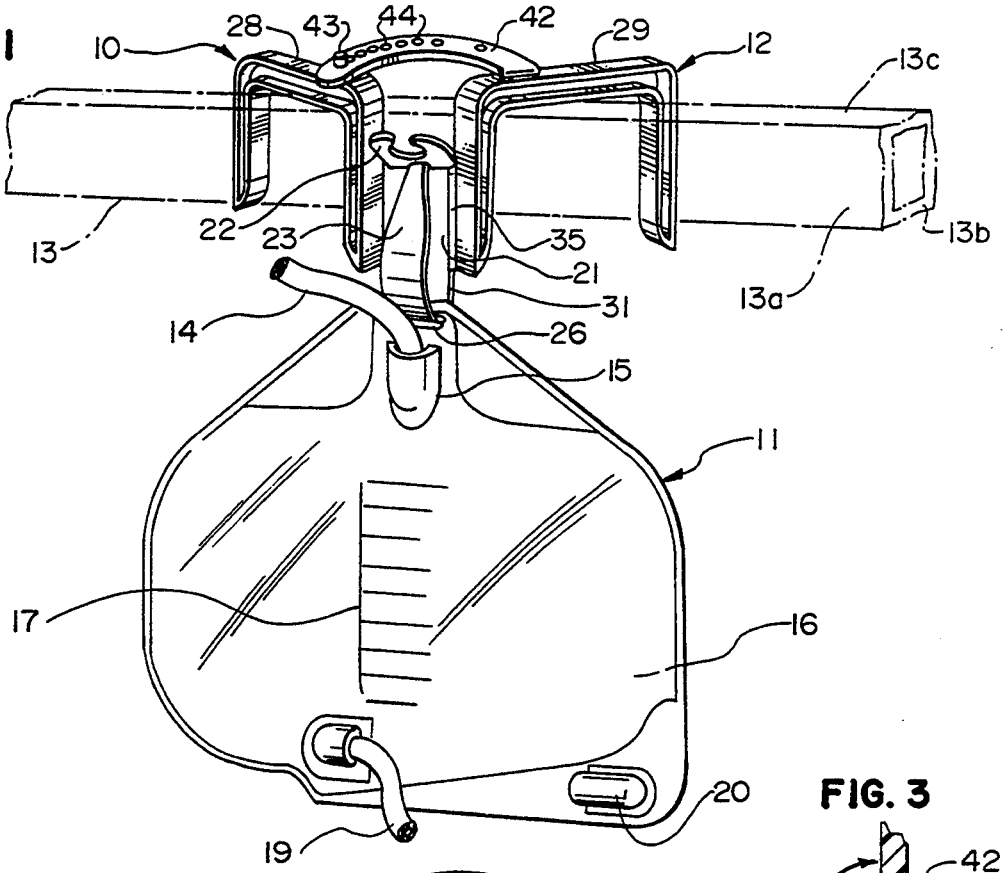
FIG. 1 is a perspective view of a collection bag hanger embodying this invention, the hanger being shown supporting a collection bag on a bedrail.
Figure 3:
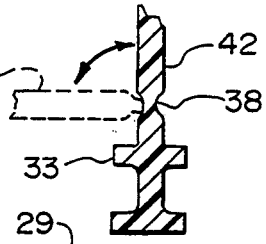
FIG. 3 is an enlarged fragmentary cross-sectional view taken along line 3—3 of FIG. 2.

In FIG. 1, the numeral 10 generally designates a fluid drainage system comprising a fluid collection bag 11, a collection bag hanger 12 hooked to a bedrail 13 supporting the bag 11, and a drainage tube 14 (partially shown) connected to an inlet 15. The bag 11 defines a chamber 16 for receiving fluid, via drainage tube 14 and inlet 15, from a catheter which has a distal end connected to a patient. Although the invention will be generally described as it relates to urinary drainage systems, it will be understood that the disclosed bag hanger may be used in conjunction with any fluid drainage system of the type commonly used in hospitals or in conjunction with other health care applications.

The bag 11 is provided with a scale 17 for measuring an output of fluid and a drain 18 for draining fluid when the bag is full. A discharge tube 19 extends from the drain 18 and when the bag is in use, the discharge tube 19 can be clamped in a manner known in the art and the free end received in the housing 20.

Hanger 12 has a central body portion 21 with a hinged collar portion 22 at its top and a hinged elongate tongue 23 extending from its bottom. Collar portion 22 includes a tongue-receiving aperture 24 and an opening 25, the opening 25 being adapted to receive and support a portion of the drainage tube 14 extending upwardly from bag 11. The flexible tongue can be extended through a slit 26 in the bag 11 and a tip 27 of the tongue received in aperture 24 for releasably supporting the bag 11 as shown in FIG. 1.

The hanger 12 includes a pair of U-shaped hook arms 28 and 29 for receiving and securingly engaging the bedrail 13. Each hook arm has a first depending leg portion 30 hingedly connected to one of the side edges 31 of the central body portion 21, a second depending leg portion 32 in spaced parallel relation to the first depending leg portion, and a substantially straight intermediate portion 33 extending between and connecting the first and second depending leg portions.

Figure 2:
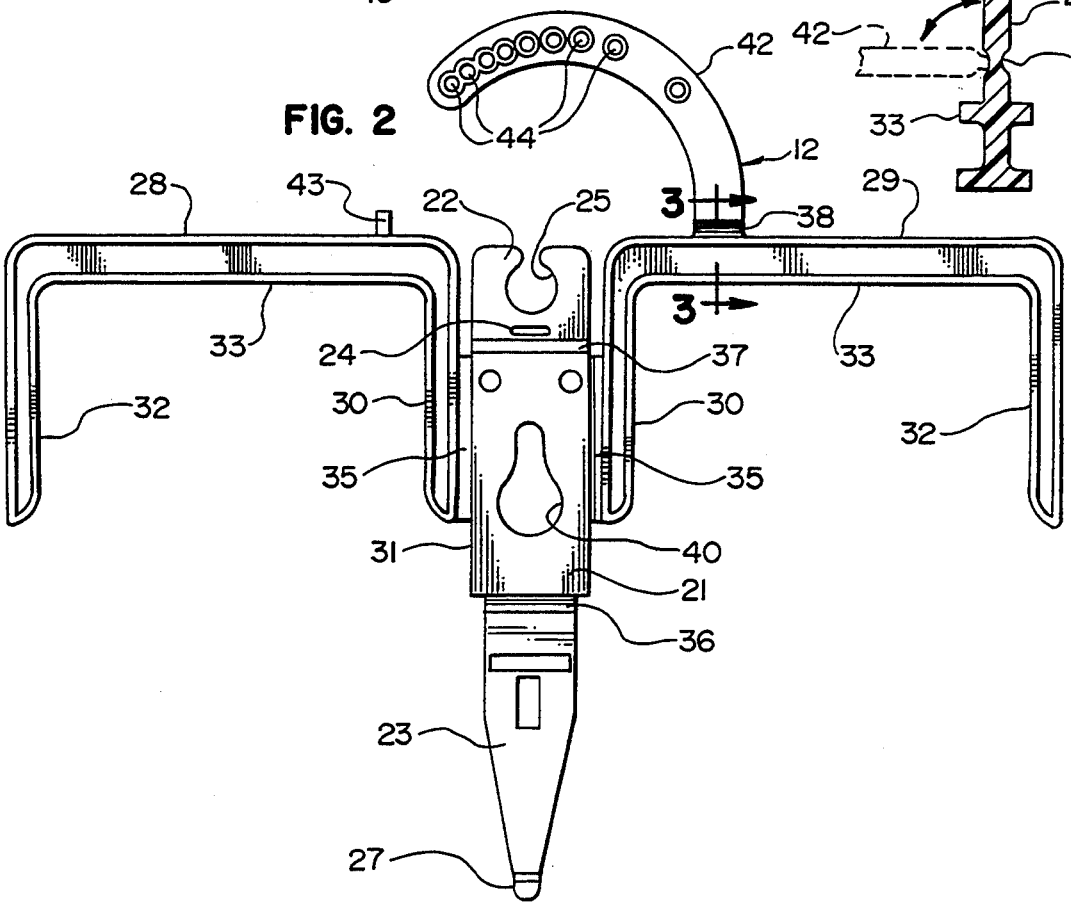
FIG. 2 is a plan view of a collection bag hanger embodying the present invention.

As shown in FIG. 2, the first depending leg 30 of each hook arm 28 and 29 is hingedly connected to one of the side edges 31 of the central body portion 21 by a thin, flexible and integral web 35. The web, which may be referred to as a "living hinge", allows the hook arms 28 and 29 to be rotated with respect to the central body portion 21 from positions in which the hook arms 28 and 29 are substantially coplanar to positions in which they are substantially parallel. Similar living hinges are provided along hinge lines 36, 37 and 38 so that all of the components of the bag hanger 12 may be integrally molded in a substantially planar mold.

If desired, the central body portion 21 may be provided with apertures 39 for receiving a tie string (not shown) and may also include an elongated aperture 40 for receiving a hook or a button-like member with which some bedrails are equipped, as additional or alternative means for securing the bag hanger 12 in place.

Bag hanger 12 is provided with linking means for securing the hook arms in any of a plurality of symmetrical angular positions, such linking means being shown in the embodiment of FIGS. 1–5 as a flat, arcuate (in outline) strap member 42. The strap member 42 and the intermediate portion 33 of at least one of the hook arms together provide releasable locking means for securing the hook arms 28 and 29 in selected angular positions corresponding to the width of the bedrail. Such releasable locking means takes the form of a locking pin 43 projecting from the intermediate portion of one of the hook arms 28 and a plurality of locking apertures 44 provided along the strap member 42, such strap member being integrally joined to the intermediate portion of the opposite hook arm 29 by connecting web 38.

Web 38 forms a hinge line that permits the relatively rigid strap member 42 to be pivoted into an operating position in which it is coplanar with the straight, horizontal intermediate portions 33 of the two hook arms 28, 29 or, stated differently, in which it extends along a plane normal to the parallel side edges 31 of the central body portion 21. Of particular importance is the fact that web 38 secures the strap member and hook arm 29 together in such a way that the only relative movement that may take place between such parts must occur about the axis of that hinge line. When the strap member is in its operative position, in which it extends in the same plane as the straight intermediate portion 33 of hook arm 29, the connecting web 38 prevents independent movement of strap member relative to such intermediate portion along that plane.

Figure 4:
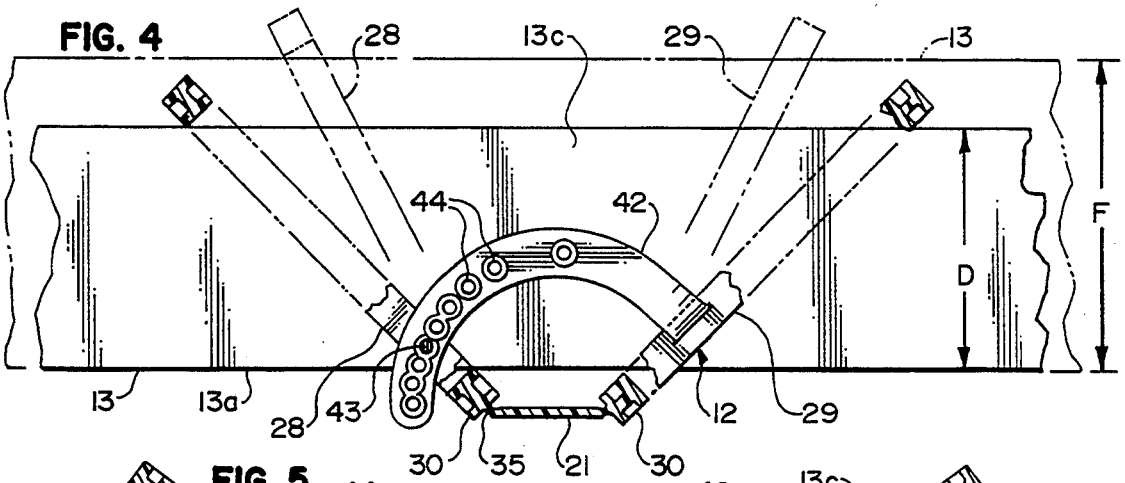
FIG. 4 is a top view of a collection bag hanger of the present invention illustrating different selected angular positions for accommodating bedrails of different widths.
Figure 5:
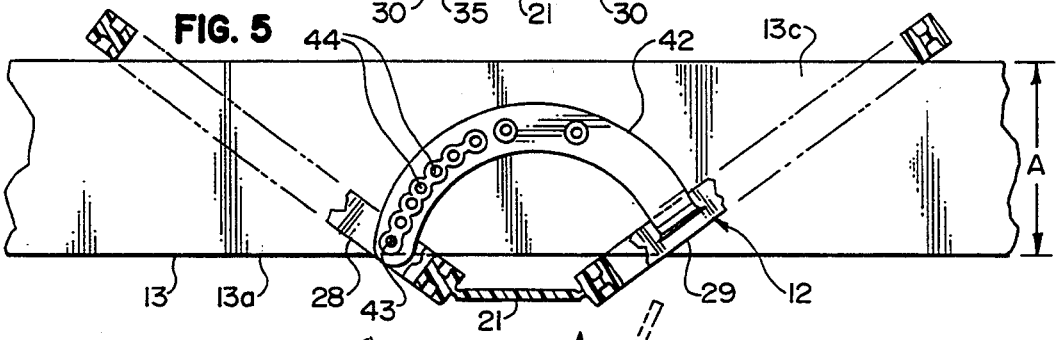
FIG. 5 is a top view of a collection bag hanger of the present invention illustrating, as an example only, the hook arms in a maximum selected angular position for receiving and securely engaging a bedrail of minimum width.

The operation of the bag hanger 12 can best be seen in FIGS. 4 and 5 which illustrate the bag hanger 12 in a variety of selected angular positions for receiving and securely engaging bedrails of different widths. In FIG. 5, the bag hanger 12 is shown engaging a bedrail 13 of width A with the strap member 42 extending along the plane of the intermediate portions 33 and releasably engaging the locking pin 43 in a locking aperture 44 distal from the hook arm 29 to which the strap member 42 is hingedly attached. In such a position, the first and second depending legs 30 and 32 are in a close spaced parallel relation so as to receive and securely engage the bedrail 13. The strap member 42 locks the hook arms 28 and 29 in such selected angular positions tightly engaging the bedrail 13 and preventing the attached collection bag 11 from tilting or falling free from the bedrail 13 as the bag 11 fills.

FIG. 4 further illustrates the bag hanger 12 with its hook arms in other selected angular positions. As shown, hook arms 28 and 29 can be hingedly rotated to accommodate bedrails of widths D and F with the hook arms 28 and 29 again being locked by strap member 42, pin 43, and a selected aperture 44 in fixed symmetrical angular positions. Whatever angular positions are selected for hook arms 28 and 29, the locking means secures such arms against rotation from those positions in response to forces that could be expected to occur during normal operation of the bag hanger. In use of the hanger, the hook arms are adjusted so that their straight depending leg portions 30 engage the vertical outwardly-facing surface **13*a* of bedrail 13 and their parallel leg portions 32 engage the oppositely-facing surface of inner wall 13*b*. Downward forces exerted by the weight of bag 11 and its contents that might otherwise tend to pivot the hook arms 28 and 29 towards each other are effectively resisted by the rigid strap member 42** and the locking means associated with it.

It is believed apparent that the hanger of this invention is particularly suited for use with bedrails of rectilinear cross section. While it is important that such a rail has an outer surface **13*a* extending along a vertical plane, the cross section need not be in the form of a complete rectangle as depicted in the drawings. For example, some bedrails take the form of angle irons of inverted L-shaped cross section, providing side and top surfaces corresponding to 13*a* and 13*c*** of the drawings.

In such case, the hook arms 28 and 29 would engage side face 13*a* and the parallel free edge of face 13*c*.

Locking pin 43 and locking apertures 44 are located so that in each of the positions of adjustment in which the hook arms may be locked, the angular relationships between the hook arms 28, 29 and central body portion 21 are the same. Such symmetry is achieved by proper location of apertures 44 in an arcuate series which allows engagement of pin 43 only when the hook arms are in positions of angular symmetry. Such locations of the apertures 44 may be established empirically; however, they may also be calculated based on the following equations:

$$X=2a\cos\phi-b\cos 2\phi$$

$$Y=2a\sin\phi-b\sin 2\phi$$

Figure 6:
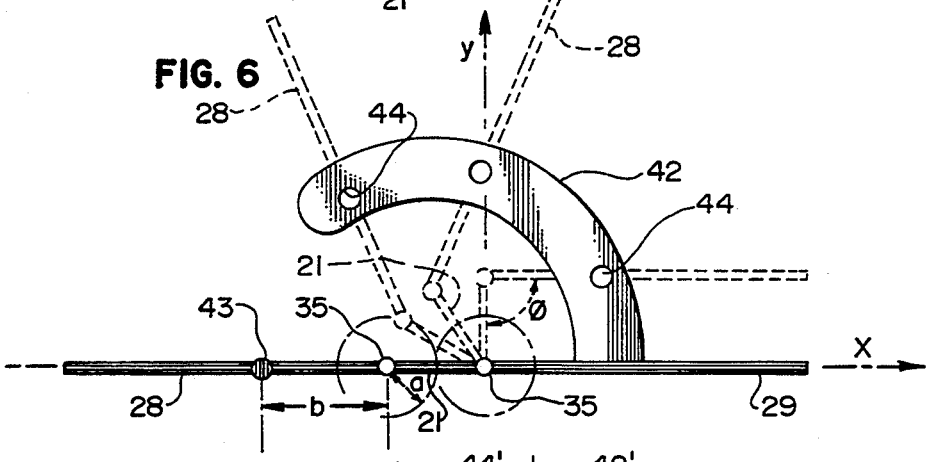
FIG. 6 is a diagrammatic top view illustrating the relationship between the parts of the bag hanger of the present invention in three different positions of adjustment.

Referring to the schematic view of FIG. 6, the symbol represents the angle between each of the hook arms 28 and 29 and the central body portion 21. For purposes of illustration, one of the hook arms 29 is fixed so as to extend along an X axis and the Y axis is drawn through one of the hinge points 35 which remains fixed. The letter "a" is a radial dimension equal to one half of the distance between the two hinge points 35, and "b" is the distance between pin 43 and the nearest (and movable) hinge point 35. Applying such formulas, the coordinates for the locations of selected openings or apertures along strap member 42 may then be calculated. It is to be noted that while the series of apertures will necessarily extend along a curved line, the strap itself need not be arcuate in outline. The arcuate configuration depicted in the drawings is desirable for economy of material and for possible other advantages but such shape is not critical for purposes of this invention.

Figure 7:
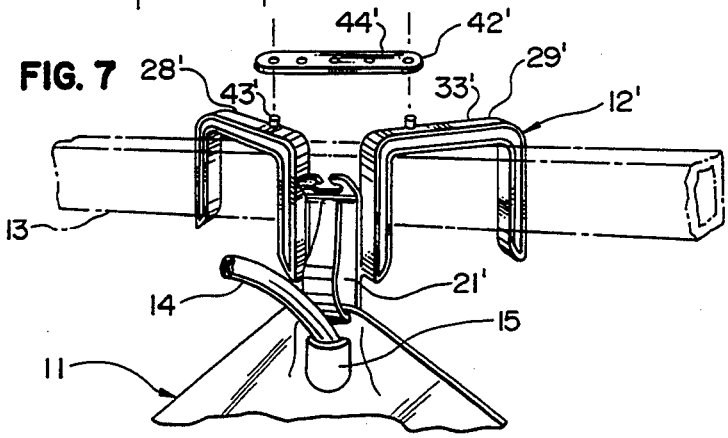
FIG. 7 is a perspective view of an alternative embodiment of the collection bag hanger of the present invention.

FIG. 7 depicts an alternative embodiment in which the hook arms 28' and 29'' of bag hanger 12' are each provided with upstanding locking pins 43' along their intermediate portions 33'. A straight strap member 42' is provided with a series of locking apertures 44'. As in the preceding embodiment, the strap member 42' and locking means 43' and 44' secure the hook arms in any of a plurality of selected angular positions. The strap member 42' like strap member 42, is sufficiently rigid to prevent the hook arms 28' and 29' from rotating inwardly in response to forces exerted by the weight of pouch 11 and its contents.

The hangers of both embodiments are most advantageously formed from a tough, rigid (or semi-rigid) material that provides sufficient stiffness and strength to support a filled drainage bag from a bedrail without deformation of the hook arms but that still provides enough flexibility to permit the flexing or hinging actions described above. A moldable thermoplastic material such as polypropylene has been found particularly effective, but other polymeric materials having similar properties may be used, as well understood in the art. It is also believed that non-polymeric materials such as aluminum and other metals, or combinations of metals, might be suitable.

While in the foregoing, embodiments of the invention have been disclosed in considerable detail for purposes of illustration, it will be understood by those skilled in the art that many of these details may be varied without departing from the spirit and scope of the invention.

I claim:

1. A collection bag hanger for attaching a fluid collection bag to a bedrail, said hanger comprising:

a central body portion having parallel side edges and having attachment means for releasably supporting a fluid collection bag;

a pair of hook arms of generally inverted U-shaped configuration each having a first depending leg portion hingedly connected to one of said side edges, a second depending leg portion in spaced parallel relation to said first depending leg portion, and an intermediate portion extending between and connecting said first and second depending leg portions;

linking means for securing said hook arms in any of a plurality of symmetrical angular positions, said linking means comprising a rigid strap member extendable between said intermediate portions of said pair of hook arms;

and releasable locking means provided by said strap member and at least one of said intermediate portions for locking said hook arms in any of said plurality of selected angular positions for receiving and securely engaging bedrails of different widths.

2. The hanger of claim 1 in which said locking means comprises a locking pin provided by at least one of said hook arms and projecting upwardly from said intermediate portion thereof, and a series of locking apertures along said strap member for selectively receiving said locking pin.

3. The hanger of claim 2 in which said strap member is permanently secured to said intermediate portion of the other of said hook arms and said locking apertures are adapted to receive said locking pin provided by the intermediate portion of said one of said hook arms.

4. The hanger of claim 3 in which said intermediate portions of said pair of hook arms are straight and extend along a plane normal to said parallel side edges of said central body portion.

5. The hanger of claim 4 in which said strap member is substantially flat and extends along the plane of said intermediate portions when said hook arms are locked together.

6. The hanger of claim 5 in which said hook arms, central body portion, and strap member are integrally formed from semi-rigid plastic material; said hook arms being hingedly connected to said central body portion by thin, flexible webs extending therebetween and said strap member being permanently and hingedly connected to the intermediate portion of said other of said hook arms by a thin, flexible connecting web.

7. The hanger of claim 6 in which said hook arms, central body portion, and strap member are substantially coplanar when said webs are unflexed.

8. The hanger of claim 7 in which said connecting web secures said strap member to said other hook arm to prevent independent relative movement of said strap member along said plane of said intermediate portion of said other hook arm.

9. The hanger of claim 8 in which said locking apertures are positioned and arranged along said strap member to produce angular symmetry between said hook arms and said central body portion at each of said selected positions in which said locking pin is received in a locking aperture.

10. The hanger of claim 1 in which said intermediate portion of each of said hook arms is provided with an upstanding locking pin; said strap member being provided with a longitudinal series of apertures for receiving said locking pins of both of said hook arms.

11. The hanger of claim 1 in which said central body portion and said hook arms are integrally formed of semi-rigid plastic material; said hook arms being hingedly connected to said side edges of said central body portion by thin, flexible webs extending therebetween.

* * * * *